United States Patent [19]

Warnest et al.

[11] 4,321,573

[45] Mar. 23, 1982

[54] TRIPPING DEVICE FOR A THERMAL PROTECTION RELAY

[75] Inventors: Albert Warnest, Freudenberg; Friedrich Ebnet, Köfering, both of Fed. Rep. of Germany

[73] Assignee: Siemens Aktiengesellschaft, Munich, Fed. Rep. of Germany

[21] Appl. No.: 135,121

[22] Filed: Mar. 28, 1980

[30] Foreign Application Priority Data

Apr. 11, 1979 [DE] Fed. Rep. of Germany ..... 2914776

[51] Int. Cl.[3] ..... H01H 61/00

[52] U.S. Cl. ..... 337/78; 337/95

[58] Field of Search ..... 337/38, 39, 46, 72, 337/73, 74, 78, 86, 95

[56] References Cited

U.S. PATENT DOCUMENTS 3,800,260 3/1974 Woodger ..... 337/78 X 4,047,140 9/1977 Anderson et al. ..... 337/78 X 4,147,999 4/1979 Eley ..... 337/78 X

*Primary Examiner*—George Harris

*Attorney, Agent, or Firm*—Kenyon & Kenyon

[57] ABSTRACT

A tripping device for a thermal protection relay, particularly a bimetal relay, has a pivoted U-shaped support bracket for a tripping lever, can be adjusted by means of an adjusting dog, and acts on a set of contacts. The U-shaped support bracket has a crosspiece which carries one end of U-shaped temperature compensation strip. The other end of the strip rests against the adjusting dog. The support bracket has support points for the support bracket and the tripping lever lying one behind another in the longitudinal direction of the bracket legs, starting at the crosspiece.

This relay design results in reduced cost of assembly and in reduced overall relay size. Also, a heretofore required contact pressure spring for the temperature compensation strip is dispensed with.

5 Claims, 7 Drawing Figures

TRIPPING DEVICE FOR A THERMAL PROTECTION RELAY

BACKGROUND OF THE INVENTION

This invention relates to a tripping device for a thermal protection relay. More particularly, it relates to a tripping device in which a pivoted U-shaped support bracket for a tripping lever, adjustable via an adjustment dog and connected to a temperature compensation strip, acts on a set of contacts.

In one known protection relay of the above-mentioned type, a U-shaped bracket is provided which extends over the entire length of the relay and has two double extensions on its legs, separated from each other, in which the support points, on the one hand, for a support bracket itself and, on the other hand, for the temperature compensation strip are carried. The support bracket is itself supported at its end, and the temperature compensating strip is pivoted in the central part, being first acted upon by the sensors and, in turn, acting on the contact arrangement. The other free end of the support bracket rests against the adjusting dog of the protection relay. For this purpose a separate spring is used.

The purpose of the present invention is to reduce the assembly cost and the overall size of the known protection relay design.

SUMMARY OF THE INVENTION

The above object and others which will become apparent from reading the detailed description of the invention are accomplished by means of a U-shaped support bracket which has the short dimension of an elongated crosspiece fastened across the legs of the U. Located one behind the other, in the support bracket, in a longitudinal direction beginning at the crosspiece, are support points for the bracket itself and for the tripping lever. The temperature compensating strip is also generally U-shaped, has one end rigidly fastened to the crosspiece of the support bracket, and, being bent around both support points, has its other end resting against an adjusting dog. In this way, by appropriate choice of the support points and force relationships, the compensating strip automatically comes to rest against the dog when the bimetal strip is in contact with the tripping lever. Thus the additional contact pressure spring of the prior art is eliminated. The tripping lever can be made of plastic, being provided with a sheet metal angle which can be adjusted via a screw. By providing a resilient tab which is bent out toward the support bracket legs and engages behind an undercut of the bearing pin, the support bracket can be put and held in place simply. By fastening the tripping lever and the temperature compensation strip side by side (in the same direction as the length of the crosspiece on the support bracket) a compact unit requiring a minimum amount of space as obtained. By making the tripping lever an angle lever, and by making the direction of action from the thermal sensor to the lever substantially parallel to the longitudinal direction of the legs of the support bracket, operation without appreciable friction losses and requiring a relatively small actuating force is obtained.

DETAILED DESCRIPTION OF THE INVENTION

Figure 1:
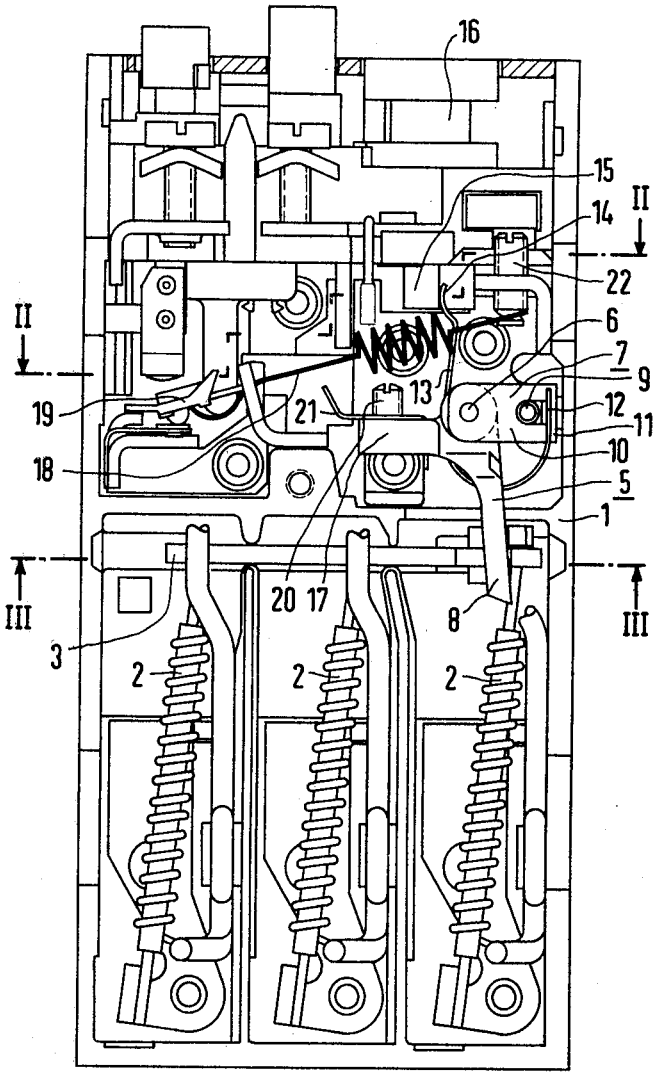
FIG. 1 is a front view of a protective relay with its cover removed, showing the improved apparatus of the invention.
Figure 2:
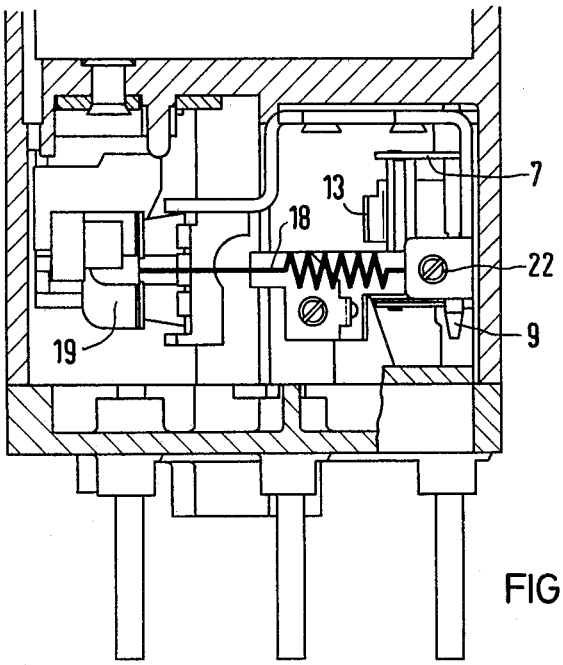
FIG. 2, a view in partial cross-section through the structure of FIG. 1, looking downward from the line II–II.
Figure 3:
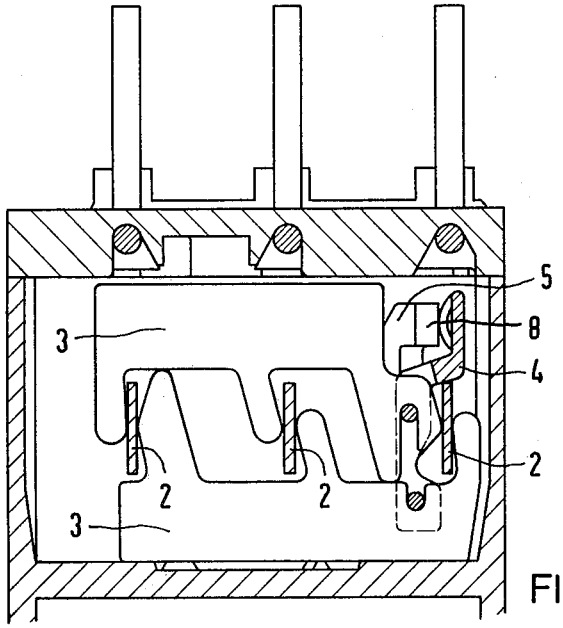
FIG. 3 is a view in partial cross-section of the structure of FIG. 1, looking upward in the region of the release sliders, from line III–III of FIG. 1.

The protective relay shown in FIG. 1 consists of a housing 1, in the lower part of which plural bimetal strips 2, constituting the thermal sensors, are fastened. The bimetal strips act on differential tripping sliders 3. Differential tripping sliders 3 are in operative connection with a tripping lever 5 via a differential lever 4 (see FIG. 3). Tripping lever 5 is an angled lever and is pivoted on a pin 6 carried on a forked (U-shaped) support bracket 7. The direction of action of differential lever 4 on arm 8 of tripping lever 5 lies essentially paralled to a line defined by the juntion points of the longitudinal axis of pin 6 and the longitudinal axis of a bearing pin 9 with the U-shaped support bracket 7. The support points are located on a line between legs 10 of support bracket 7. One end of U-shaped temperature compensation strip 13 is welded to elongated crosspiece 11 formed on support bracket 7. The other end 14 of temperature compensation strip 13 is braced against a dog 15, which is carried on a setting eccentric 16, at least when bimetallic strip 13 is deflected. In this process, support bracket 10 is put in its most extended position and tripping lever 5 comes into contact with an arm 17 which engages dead-center spring 18 of contact arangement 19. A sheet metal angle 21 for setting the tripping point is adjustably fastened on arm 17 by means of an adjusting screw 20. Another adjusting screw 22 serves for adjusting the position of the fixed end of dead-center spring 18.

Figure 4:
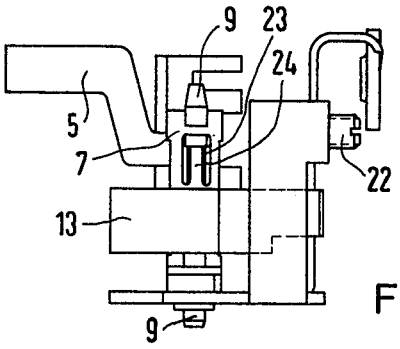
FIG. 4 and 5 are side and top views of the tripping mechanism pre-assembled as a unit.
Figure 5:
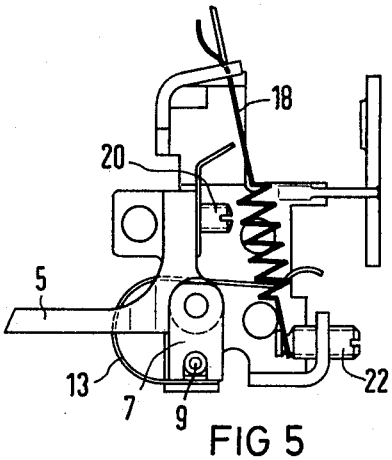
Figure 6:
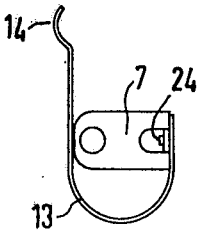
FIG. 6 and 7 are top and side views of a support bracket designed in accordance with the teachings of the invention, showing the temperature compensation strip welded thereto.
Figure 7:
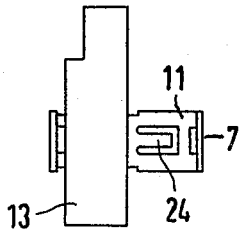

As can be seen in FIG. 4, temperature compensation strip 13 and tripping lever 5 are arranged side by side in a direction parallel to the long dimension of crosspiece 11 of support bracket 7. Pivot pin 9 for support bracket 7 has an undercut 23, into and under which a punched-out tab 24 on cross-piece 11 of support bracket 10 snaps, when the support bracket is put in place, so that no further means for holding the support bracket are required. As FIGS. 4 and 5 show, the tripping mechanism can be placed in the housing 1 as a prefabricated subassembly, which especially simplifies the production process, in view of automation.

As seen in FIG. 1, the drawing shows that, in accordance with the teachings of the invention, contact of end 14 of temperature compensation strip 13 with setting dog 15 is made, when the differential slides 3 are displaced in the direction of the release, without the use of additional springs. Because temperature compensation strip 13 is U-shaped and goes around both of the support points 6 and 9, a compact design is obtained which enables the protective relay to be accommodated in a relatively small housing.

What is claimed is:

1. In a tripping device for a thermal protection relay having a pivoted U-shaped support bracket for a tripping lever which acts on a set of contacts, can be adjusted by means of an adjusting dog, and is connected to a temperature compensation strip, the improvement comprising:

a pair of legs on the support bracket, a crosspiece mounted on the legs, and, reading from the crosspiece in the longitudinal direction of the bracket, support points for the support bracket and for the tripping lever located one behind the other; and a U-shaped temperature compensation strip, passing around both support points, which is rigidly fastened at one end to the crosspiece of the support bracket and seated at the other end against the adjusting dog.

2. In a protection relay according to claim 1, the further improvement comprising:

the tripping lever being made of plastic and having a sheet metal angle plate adjustably fastened thereto by a screw.

3. In a protection relay in accordance with one of claim 1 and claim 2, the improvement comprising:

the support bracket having a resilient tab on the crosspiece which is bent outward of the legs and engages an undercut of the pivot pin.

4. In a protection relay in accordance with one of claim 1 and claim 2, the further improvement comprising:

the tripping lever and the temperature compensation strips being fastened in positions which are laterally displaced in the longitudinal direction of the support bracket crosspiece.

5. In a protective relay in accordane with claim 4, the improvement comprising:

the tripping lever being an angle lever and the direction of action from the thermal sensor to the tripping lever being substantially parallel to the longitudinal direction of the legs of the support bracket.

* * * * *